US007469711B2

(12) United States Patent
Costas

(10) Patent No.: US 7,469,711 B2
(45) Date of Patent: Dec. 30, 2008

(54) WATER SUPPLY PASS-THROUGH APPARATUS

(76) Inventor: William Costas, 26171 Mountainview Blvd., Brooksville, FL (US) 34602

( * ) Notice: Subject to any disclaimer, the term of this patent is extended or adjusted under 35 U.S.C. 154(b) by 0 days.

(21) Appl. No.: 11/687,692

(22) Filed: Mar. 19, 2007

(65) Prior Publication Data

US 2007/0164171 A1 Jul. 19, 2007

Related U.S. Application Data

(62) Division of application No. 10/866,669, filed on Jun. 15, 2004, now abandoned.

(60) Provisional application No. 60/479,449, filed on Jun. 19, 2003.

(51) Int. Cl.
*F16L 5/00* (2006.01)

(52) U.S. Cl. ..... 137/360; 4/498

(58) Field of Classification Search ..... 137/359, 137/360; 4/498, 507; 248/57–60
See application file for complete search history.

(56) References Cited

U.S. PATENT DOCUMENTS 1,904,330 A * 4/1933 Ruff ..... 137/360
2,661,483 A * 12/1953 Tortorice ..... 4/695
2,824,312 A * 2/1958 Tortorice ..... 4/695
3,009,167 A * 11/1961 Leonard, Jr. ..... 4/695
3,021,103 A * 2/1962 Beyerle ..... 248/57
3,036,814 A * 5/1962 Stevens ..... 251/299
3,148,698 A * 9/1964 Arnold ..... 137/360
3,175,575 A * 3/1965 Kennedy ..... 137/360
4,909,461 A * 3/1990 Collins ..... 248/68.1
5,371,907 A * 12/1994 Horvath ..... 4/498
5,607,127 A * 3/1997 Ballonez ..... 248/72
7,210,493 B1 * 5/2007 Wang ..... 137/15.01
2004/0055081 A1 * 3/2004 Wilson ..... 4/498
2004/0154089 A1 * 8/2004 Laijok-Puska ..... 4/498
2005/0108817 A1 * 5/2005 Wilson et al. ..... 4/498

* cited by examiner

*Primary Examiner*—Stephen M Hepperle
*Assistant Examiner*—Cloud K Lee
(74) *Attorney, Agent, or Firm*—Dennis G. LaPointe

(57) ABSTRACT

A pair of specially designed plates that are mounted to the framing of a screened enclosure, enabling the installation of a hose bib and hose bib to garden hose adapter, providing a water supply through the screen of the enclosure. This provides a garden hose connection and water flow control point within the screened enclosure. An ordinary garden hose is attached to a hose bib outside the screened enclosure and to the hose bib to garden hose adapter providing the water supply.

2 Claims, 3 Drawing Sheets

WATER SUPPLY PASS-THROUGH APPARATUS

RELATED APPLICATION

This application is a divisional of U.S. patent application Ser. No. 10/866,669 filed Jun. 15, 2004, which claims the benefit of U.S. provisional patent application 60/479,449 filed Jun. 19, 2003.

BACKGROUND OF THE INVENTION

The present invention provides a unique screen pass through apparatus that provides a watering hose connection inside a screened enclosure such as used to enclose pools. Generally, most homes that have an in ground pool installed with a screened enclosure do not have a hose bib installed within the enclosure. It is awkward to bring a hose in through the enclosure door for the purpose of filling lost water in the pool, watering decorative plants, cleaning the patio floor, etc. because 1) the hose gets caught under the door, 2) pets try to escape through the opened enclosure door, and 3) bugs enter the screened enclosure through the opened door defeating the purpose of the enclosure.

The object of the present invention is to provide an extension apparatus mounted to the framing of the screened enclosure providing a hose bib within the enclosure for watering needs. The apparatus is connected to a hose bib outside the enclosure which supplies the water via an ordinary garden hose.

SUMMARY OF THE INVENTION

A unique hose bib extension apparatus mounted to the frame of a screened enclosure providing a garden hose connection and water flow control point within the screened enclosure. The assembly includes two specially designed plates for mounting to the screened enclosure frame enabling the mounting of a hose bib and hose bib to garden hose adapter providing a water supply through the screen of the enclosure. An ordinary garden hose is attached to a hose bib outside the screened enclosure and to the hose bib to garden hose adapter providing the water supply.

DETAILED DESCRIPTION OF THE INVENTION

Figure 1:
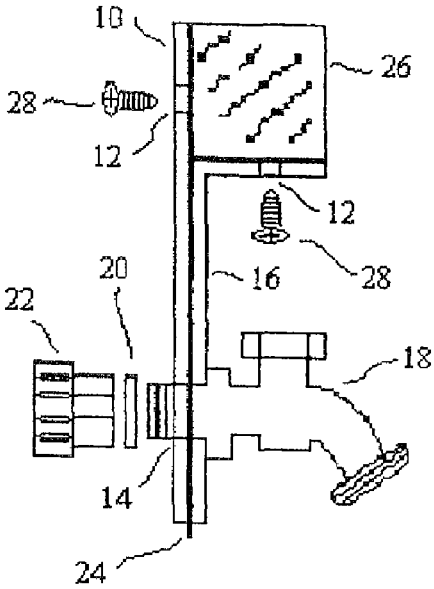
FIG. 1 is a side view of the screen pass through apparatus mounted to the screened enclosure.
Figure 2:
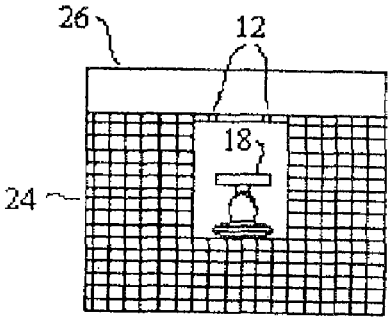
FIG. 2 is the front view of the screen pass through apparatus mounted to the screened enclosure.
Figure 3:
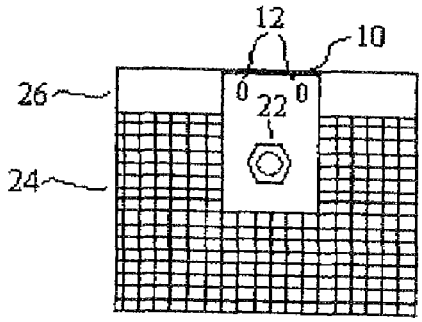
FIG. 3 is the back view of the screen pass through apparatus mounted to the screened enclosure.
Figure 4:
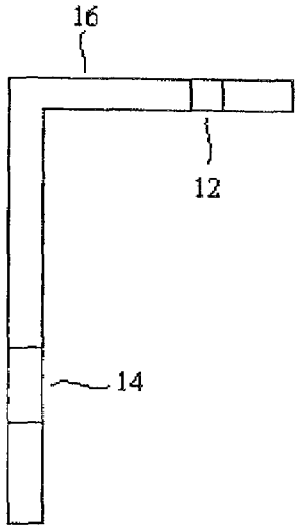
FIG. 4 is the right side view of the L mounting bracket.
Figure 5:
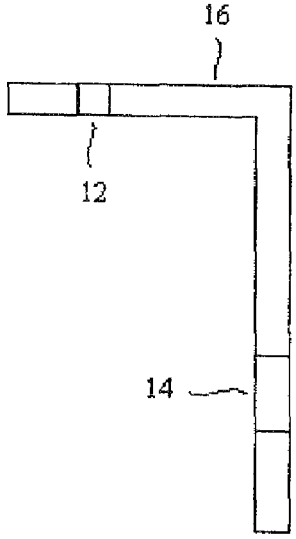
FIG. 5 is the left side view of the L mounting bracket.
Figure 6:
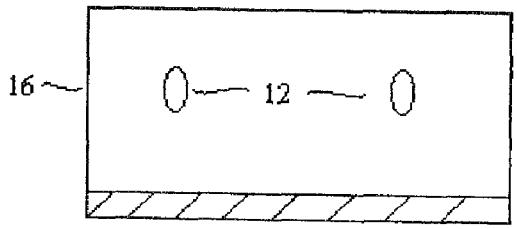
FIG. 6 is the bottom view of the L mounting bracket.
Figure 7:
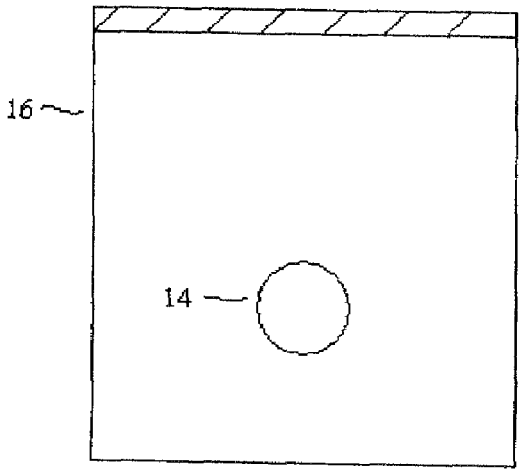
FIG. 7 is the front view of the L mounting bracket.
Figure 8:
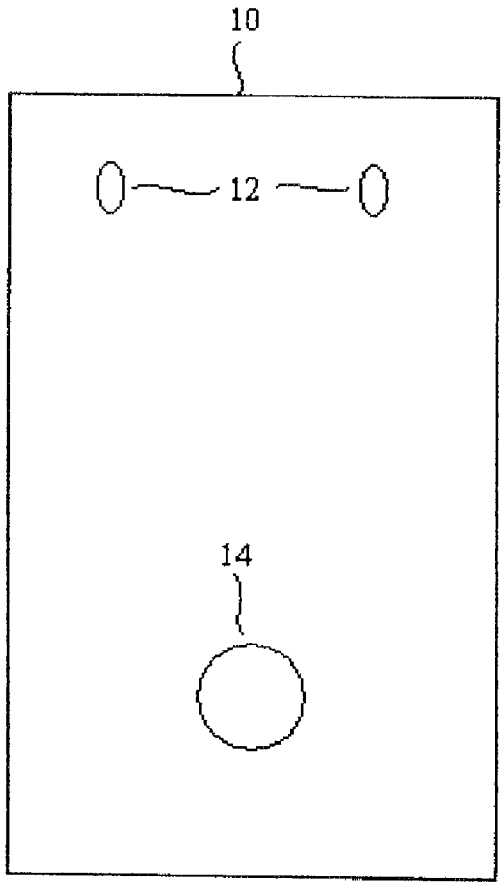
FIG. 8 is the front view of the flat mounting bracket.
Figure 9:
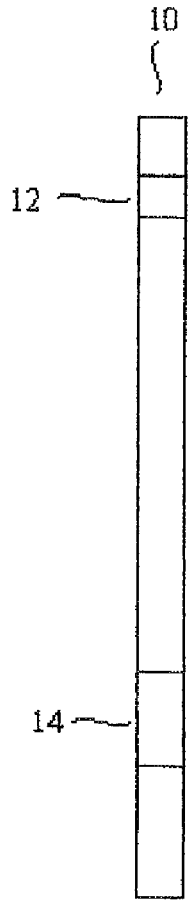
FIG. 9 is the side view of the flat mounting bracket.

Referring now to the drawings in detail wherein like reference numerals have been used throughout the various figures to designate like elements, there is shown in FIG. 1, the apparatus mounted to the frame 26 of the screened enclosure. The Water Supply Pass-Through Apparatus contains two specially designed mounting plates. The front mounting plate 16 is an L-shaped plate containing two oval screw-mounting holes in the shorter side of the L, and one hose bib-mounting hole in the longer side of the L. The back mounting plate is a flat plate 10 containing two oval screw-mounting holes near the top of the plate, and one hose bib-mounting hole near the bottom of the plate. The hose bib-mounting holes are located in the same position on the flat plate 10 as the L-plate 16 so when they are mounted, the holes line up. The L-plate 12 is mounted to the inside of the screen enclosure. The flat plate 10 is aligned with the L-plate 16 and mounted to the outside of the screen enclosure. The flat plate is mounted using stainless steel screws 28 through the oval mounting holes 12 FIG. 8. The L-plate is mounted using stainless steel screws 28 through the oval mounting holes 12 FIG. 6. A hole the size of the hose bib mounting hold 14 FIG. 7, is cut in the enclosure screening 24 and the hose bib 18 is inserted through the two mounting plates 10 & 12, and the screen 24, and secured to the plates with the washer 20 and the adapter 22. By connecting an ordinary garden hose to the hose bib to hose thread adapter 22, and to a hose bib outside of the screened enclosure, water is supplied to the Water Supply Pass-Through Apparatus. A garden hose can now be connected to the hose bib on the Water Supply Pass-Through Apparatus providing a controlled water supply inside the screened enclosure.

I claim:

1. A pair of mounting brackets for effecting a plumbing penetration through the screen of a screened enclosure comprising:

one flat and one angled bracket, with a plurality of holes formed therein;

at least one of said holes located near the bottom of the flat bracket and the bottom of the longer side of the angled bracket and being adapted to receive a hose bib and means for securing said plates to the frame of the screened enclosure.

2. The method for securing a hose bib to a screened enclosure of claim 1 where the hose bib is located in the screen area of the enclosure.

* * * * *